US006578847B1

(12) United States Patent
Hedrick et al.

(10) Patent No.: US 6,578,847 B1
(45) Date of Patent: Jun. 17, 2003

(54) PROTECTED COIN TRAY FOR USE WITH A GAMING DEVICE

(75) Inventors: Joseph R. Hedrick, Reno, NV (US); Jean P. Legras, Reno, NV (US); Kehl T. LeSourd, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/685,186

(22) Filed: Oct. 11, 2000

(51) Int. Cl.[7] ..... A63B 71/00; A63B 1/00

(52) U.S. Cl. ..... 273/138.2; 273/143 R; 273/148 R; 293/142; 463/20; 463/46

(58) Field of Search ..... 273/143 R, 198 R, 273/138.1, 138.2, 121 B; 463/20, 46; 293/142–145

(56) References Cited

U.S. PATENT DOCUMENTS

| | | | | |
|---|---|---|---|---|
| 1,858,569 A | * | 5/1932 | Woodworth | 293/142 |
| D275,208 S | | 8/1984 | Nutting | |
| D275,209 S | | 8/1984 | Nutting | |
| D284,592 S | | 7/1986 | Drews et al. | |
| 4,648,600 A | | 3/1987 | Olliges | |
| 4,695,053 A | | 9/1987 | Vazquez, Jr. et al. | |
| 4,813,675 A | | 3/1989 | Greenwood | |
| D307,771 S | | 5/1990 | Cesaroni et al. | |
| 4,926,327 A | * | 5/1990 | Sidley | 364/412 |
| 4,991,848 A | | 2/1991 | Greenwood et al. | |
| 5,611,535 A | | 3/1997 | Iiberlo | |
| 5,813,914 A | * | 9/1998 | McKay et al. | 463/46 |
| D400,597 S | | 11/1998 | Hedrick et al. | |
| D403,363 S | | 12/1998 | McGahm et al. | |
| D404,084 S | | 1/1999 | Hedrick et al. | |
| D404,436 S | | 1/1999 | McGahn et al. | |
| D406,615 S | | 3/1999 | Griswold et al. | |
| D412,347 S | | 7/1999 | DeSimone et al. | |
| D416,054 S | | 11/1999 | McGahn et al. | |
| 5,984,781 A | | 11/1999 | Sunaga | |
| 6,012,982 A | | 1/2000 | Piechowiak et al. | |
| D421,277 S | | 2/2000 | McGahn et al. | |
| 6,056,642 A | | 5/2000 | Bennett | |
| 6,102,798 A | | 8/2000 | Bennett | |
| 6,113,098 A | | 9/2000 | Adams | |
| 6,161,805 A | | 12/2000 | Wells | |
| 6,164,645 A | | 12/2000 | Weiss | |
| 6,168,522 B1 | | 1/2001 | Walker et al. | |

FOREIGN PATENT DOCUMENTS

JP 407275470 A * 10/1995

OTHER PUBLICATIONS

Comfort Gaming Casino Products (website) written by www.comfortgaming.com, printed Apr. 23, 2001.
Comfort Gaming (website) written by www.comfortgaming.com, printed Jan. 16, 2002.
Comfort Gaming (website) written by www.comfortgaming.com, printed Apr. 23, 2002.
Slot Machines published by Reno–Tahoe Specialty, Inc. in 1989.
Elvis Brochure published by IGT in 1999.
Wheel of Fortune Video published by IGT in 1999.
Wheel of Fortune Brochure published by IGT in 1998.
Mega Jackpots Brochure published by IGT in 1998.
Top Dollar Brochure published by IGT in 1998.
Keno Machine Picture published by IGT.
Morph Game Pictures published by IGT on Sep. 12, 1999.

* cited by examiner

*Primary Examiner*—Benjamin H. Layno
(74) *Attorney, Agent, or Firm*—Bell, Boyd, & Lloyd LLC

(57) ABSTRACT

The present invention relates to a protected coin tray for use with a gaming device. The coin tray is made from a urethane cushioning material attached to the housing of the gaming device. The coin tray has inner and outer surfaces. The inner surface is adapted to receive a gaming device payout. A metal layer is applied to the inner surface of the coin tray to provide a desired metallic sound when a payout of a metallic coin is dispensed. The outer surface of the coin tray is rounded, and the urethane cushioning material acts as a bumper to protect gaming device players from injury.

1 Claim, 3 Drawing Sheets

PROTECTED COIN TRAY FOR USE WITH A GAMING DEVICE

This application is related to the following commonly-owned corresponding design patent applications: "Player Interface and Tray for a Gaming Device," Ser. No. 29/130,983, and "Tray For A Gaming Device," Ser. No. 29/130,981,

DESCRIPTION

The present invention relates in general to a coin tray, and more particularly to a protected coin tray for use with a gaming device that protects the player.

BACKGROUND OF THE INVENTION

Gaming devices currently exist which preferably enable players to win awards. Whether the player wins a large or a small award, the gaming device includes a coin tray designed to receive or catch the award for easy retrieval by the player. These trays are preferably metal, so that the coins make a distinctive ringing sound when they strike the trays. This distinctive sound is attractive to players.

It should be appreciated that space in a gaming area of a casino is at a premium. Casinos generally place as many gaming devices as possible in the gaming area, providing a small amount of space for players to use the devices and for passerbys to pass.

Prior art gaming devices have extended coin trays which are generally higher off of the ground. However, gaming devices now include new machine configurations that are more ergonomic, including coin payout trays.

It should be appreciated that such metal coin trays that extend from a front surface of the gaming device may cause players to bang their shins or other body parts on the coin tray while playing the game. Further, passersby may bang their shins or other body parts on the tray in passing.

SUMMARY OF THE INVENTION

The present invention overcomes the above shortcomings by providing a protected coin tray for use with a gaming device that protects people such as players and passersby. The protected coin tray also protects the coin tray and the device itself from damage.

The gaming device includes a coin payout tray that is connected to and extends outwardly from a front surface of the gaming device. The coin tray has a generally rounded appearance when viewed from above. The coin tray includes a bottom wall and a side wall connected to the bottom wall. The side wall has inner and outer surfaces, two ends, and an upper edge. Preferably the coin tray is made of durable and attractive metal material.

The protected coin tray of the present invention includes a protective portion or bumper that in one embodiment is connected or fixed to at least a portion of the outer surface of the side wall of the coin tray. It should be appreciated that the protective portion could contact the entire outer surface of the side wall of the coin tray. The protective portion is preferably made of urethane, although any other suitable cushioning material is contemplated (including without limitation natural or synthetic rubber or plastic, polyvinylchloride, polyvinylacetate, a foam product, acrylic, or other suitable material, etc.).

The protective portion or bumper includes an elongated portion and curved portions connected to and integral with opposite ends of the elongated portion. The bumper further includes a member which is connected to, integral with and extends from each of the curved portions so that the bumper has a general U-shape when viewed from above.

The bumper is preferably formed as a single unit with an inner surface and an outer surface where the inner surface is adapted to be joined or affixed to at least a portion of, if not the entire, outer surface of the side wall of the coin tray. It is contemplated that the elongated portion of the bumper is curved to fit the outer surface of the side wall of the coin tray. It is also contemplated that the elongated portion is straight, angled or has any other shape, depending on the shape of the coin tray.

The bumper may be connected to the side wall of the outer surface of the coin tray using any suitable mechanism. For instance, glue, adhesive, bonding, tape, or other contact devices could be used. It should be appreciated that the bumper could be removably or permanently attached to the coin tray using mechanical fasteners such as rivets, studs, bolts, screws, pegs, tabs or any other suitable fastening device or system. It should also be appreciated that the bumper could be molded on a support panel (preferably made of steel) which is suitably attached to the coin tray.

It is an object of the present invention to provide a protected coin tray for use with a gaming device.

Other objects, features and advantages of the invention will be apparent from the following detailed disclosure, taken in conjunction with the accompanying sheets of drawings, where in like numerals refer to like parts.

DETAILED DESCRIPTION OF THE INVENTION

Figure 1:
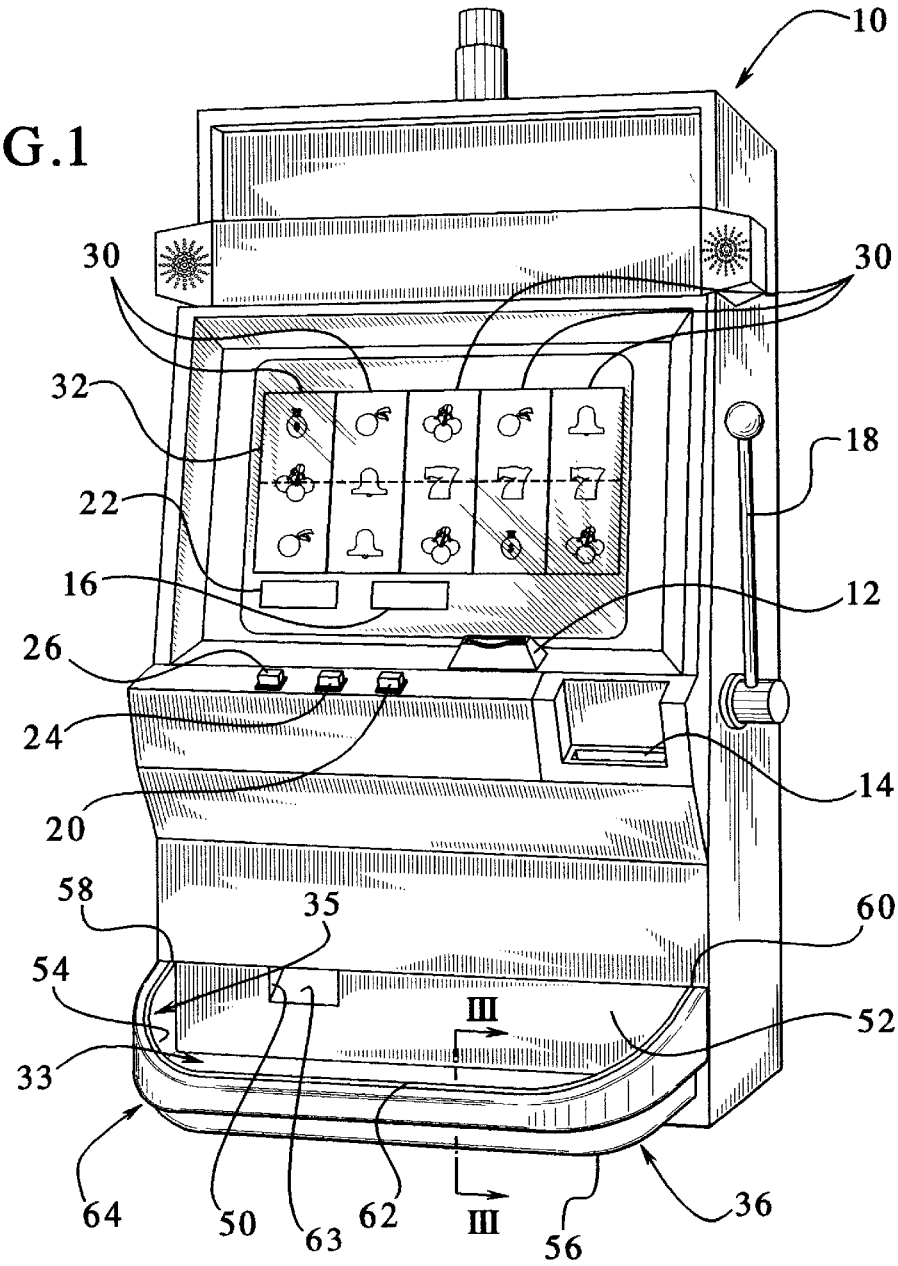
FIG. 1 is a perspective view of one embodiment of the gaming device of the present invention illustrating the protected coin tray.

Referring now to the drawings, a gaming device 10 of one embodiment of the present invention, which is preferably a slot machine or a card machine having the controls, displays and features of a conventional slot machine is generally illustrated. Gaming device 10 is constructed so that a player can operate gaming device 10 while standing or sitting. However, it should be appreciated that gaming device 10 can be constructed as a pub-style table-top game (not shown) which a player can operate preferably while sitting.

Gaming device 10 can incorporate any primary game such as slot, poker, blackjack, bingo or keno in addition to any suitable bonus scheme related thereto. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20 or activating any other mechanism (including a touch screen) which starts the game.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

In one embodiment, the gaming device 10 has a display window which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at display 32 instead of at the display window.

The display 32 is selected from the group consisting of cathode ray tubes "CRTs", high resolution flat panel LCDs, projection type LCDs, plasma displays, field emission displays, digital micromirror displays, LCD touchscreens, flat TV displays or other suitable displays. The display 32 is capable of portraying or displaying images, symbols and other indicia including images of people, characters, places, things and card faces associated with the game. This display 32 generally attracts patrons to play the game.

At any time during the primary game, a player may cash out of the game and thereby receive a number of coins corresponding to the number of player credits by pushing a cash out button 26. When the player cashes out, the player receives the coins or award in a coin payout tray 36.

The gaming device 10 defines a payout aperture 50 that fluidly communicates with a cashbox (not shown) via a duct, trough, conduit or other channel (not shown). The payout aperture 50 is adapted to receive the gaming device payout. The gaming device 10 includes a coin payout tray 36 that preferably contacts a front surface 52 of gaming device 10 and is in fluid communication with payout aperture 50. The coin tray 36 has a generally rounded appearance when viewed from above.

The protected coin tray of the present invention includes a substantially horizontally extending bottom wall 33 and an upright side wall 35 connected to the bottom wall 33. The side wall 35 of the coin tray 36 includes inner (or first) and outer (or second) surfaces 54 and 56, ends 58 and 60, and edge 62. In one embodiment, ends 58 and 60 contact front surface 52. It should be appreciated that other embodiments are contemplated, including having a portion of the coin tray 36 extending into payout aperture 50 so that outer surface 56 contacts an outer surface 63 of the payout aperture 50, and a portion of the coin payout tray 36 acts as a liner for the payout aperture 50. Further, while a generally rounded coin tray 36 is illustrated, other embodiments including a generally rectangular (box-shaped) or angled coin tray 36 are contemplated.

Preferably the coin tray 36 is made of a durable attractive metal including stainless steel or brushed aluminum, although other suitable materials are contemplated. While it is preferred that the entire coin tray 36 is made of the same metal, it is also contemplated that the coin tray 36 is made of different metals or that only a portion of the coin tray 36 (the inner surface 54 for example) is comprised of metal as discussed below.

As illustrated in FIG. 1, the protected coin tray 36 includes a protective portion or cover 64 which is attached or fixed to at least a portion of the outer or second surface 56 of the side wall 35 of the coin tray 36. The protective portion or cover 64 is alternatively referred to herein as a bumper. The bumper 64 is preferably made of urethane, although other materials are contemplated, including without limitation a natural or synthetic rubber or plastic, polyvinylchloride, polyvinylacetate, a form product, acrylic, etc.

It should be appreciated that the protective portion 64 contacts a portion of or the entire outer surface 56 of the side wall 35. That is, the coin tray 36 is made of a suitable metal and the urethane protective cover 64 is attached or connected to a portion of or the entire outer surface 56 of the side wall 35 of the coin tray 36.

Figure 2:
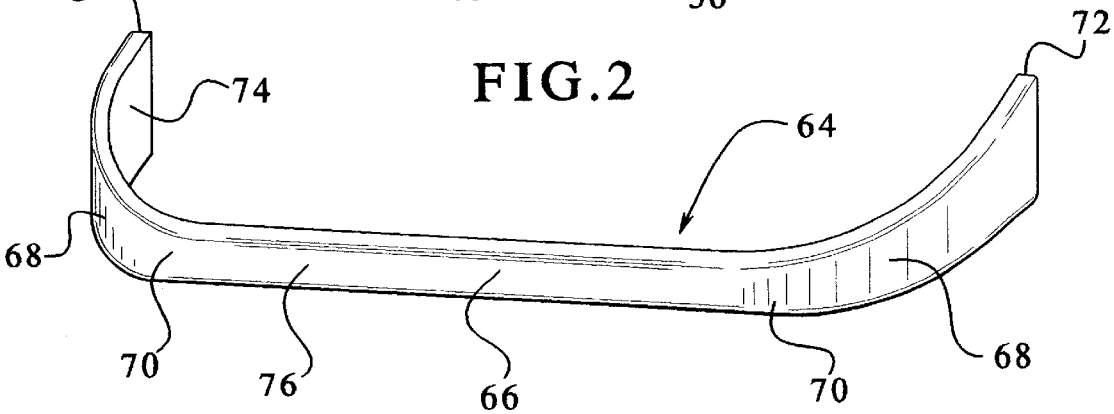
FIG. 2 is a top perspective view of the protective cover or bumper of FIG. 1.

The preferred embodiment of the bumper 64 includes an elongated portion 66 and curved portions 68 connected to and integral with opposite ends 70 of the elongated portion 66 as illustrated. The bumper 64 includes two members 72 which are respectively connected to, integral with and extend from the curved portions 68 (generally transversely to the elongated portion 66) so that the bumper 64 has a general U-shape when viewed from above. It should be appreciated that the bumper 64 is formed as a single unit as illustrated in FIG. 2 However, it is contemplated that the bumper 64 could be formed of a plurality of units which are affixed or joined together to form a single unit.

Figure 3:
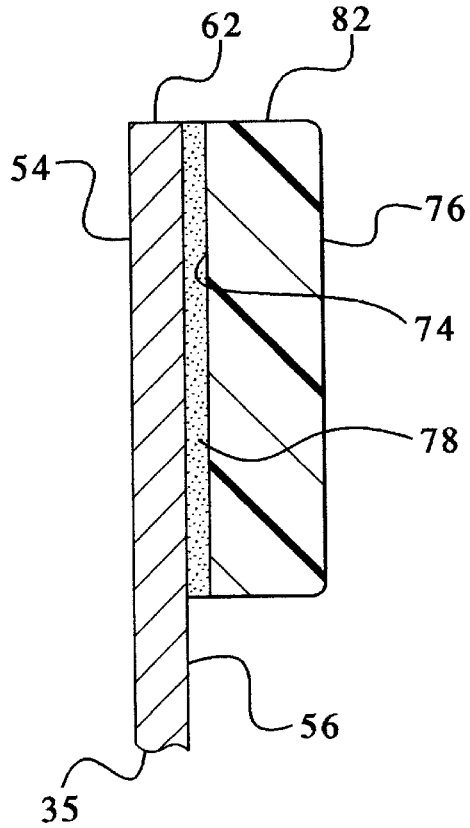
FIG. 3 is an enlarged cross-sectional view of the side wall of the coin tray (fragmentary) and the protective cover taken substantially along line III—III of FIG. 1.

The bumper 64 is formed with a first or inner surface 74 and a second or outer surface 76 where the first surface 74 is adapted to be joined or affixed to at least a portion, if not the entire, outer surface 56 of the side wall 35 of the coin tray 36 as illustrated in FIG. 3. It is contemplated that the elongated portion 66 of the bumper 64 is curved to fit the outer surface 56 of the side wall 35 of the coin tray 36 as illustrated in FIGS. 1 and 2. It is also contemplated that the elongated portion 66 is straight, angled or has any other shape, depending on the shape of the coin tray 36.

In one embodiment, the bumper 64 is affixed to the outer surface 56 of the side wall 35 of the coin tray 36 using a glue, adhesive, bonding, tape or other contact fixing device 78 as illustrated in FIG. 3. It should be appreciated that the bumper 64 could be removably attached to the side wall 35 of the coin tray 36 or another part of the coin tray using any suitable mechanical fasteners such as rivets, studs, bolts, screws, pegs or tabs. It should also be appreciated that the bumper could be molded on a support panel (preferably made of steel) which is suitably attached to the coin tray.

Preferably, the bumper 64 is formed so that the elongated portion 66 has a narrow diameter in comparison to the diameter of the extending members 72, providing an attractive and non-intrusive appearance to the player. However, it also contemplated that the elongated portion 66 has the same or greater diameter than the extending members 72.

Figure 4:
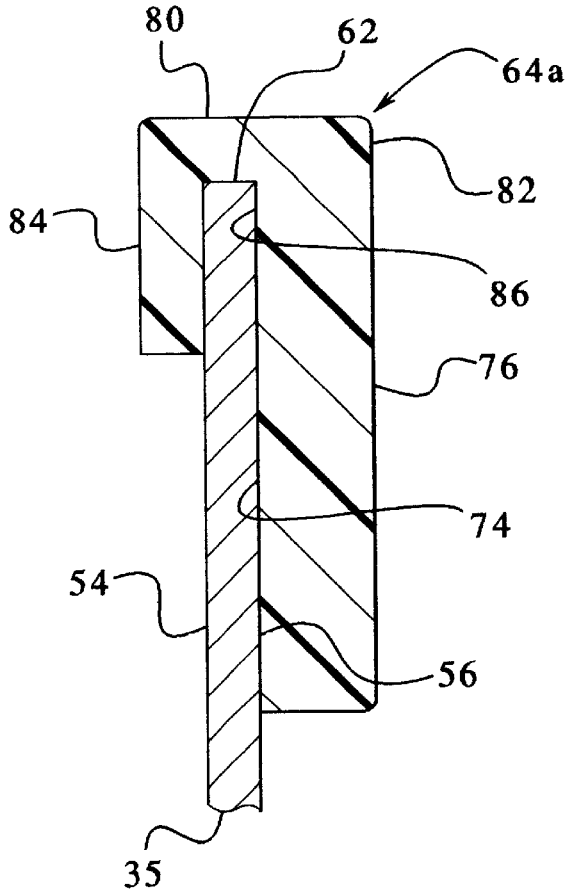
FIG. 4 is an enlarged cross sectional view of an alternative embodiment of the protected coin tray of the present invention.

An alternative embodiment of a bumper for use with the side wall 35 of the coin tray is illustrated in FIG. 4. In this embodiment, the bumper **64*a* is adapted for use with one or more types of coin trays, engaging the edge 62 of the side wall 35 of the coin tray 36. The bumper 64*a* has an elongated portion, curved portions and extending members as described previously. Bumper 64*a* (including elongated portion, curved portions and extending members) is formed with an edge 80 connected to and extending generally transversely from upper portion 82 of the bumper 64***a*. A lip 84 extends generally transversely from edge 80 and substantially parallel to the elongated member defining aperture 86 as illustrated. In one preferred embodiment, lip 84 is equally spaced from the first surface 74 of bumper 64*a* although other embodiments with varied spacing are contemplated.

It should be appreciated that aperture 86 is adapted to fit over edge 62 of the side wall 35 of the coin tray, so that preferably a portion of lip 84 contacts inner surface 54. In this embodiment, bumper 64*a* is adapted to engage coin tray 36 using a friction fit or in a snap-like fashion although other methods are contemplated such as adhesives, glues, bindings, screws and other fasteners.

Although not shown, other embodiments of the present invention are contemplated including a bumper comprising only an elongated portion, where the bumper only connects to the outermost extending portion of the side wall of the coin tray. It should be appreciated that an alternative bumper could be comprised of a soft, malleable material, adapted to fit coin trays of any shape and size.

It should further be appreciated that the entire coin tray, or the side wall of the coin tray, or an outer portion of the side wall of the coin tray could be made of a suitable cushioning material such as plastic, urethane, polyvinylchloride, polyvinylacetate or other suitable material and may include a metal layer applied to the inner surface thereof to effectuate the coin sound.

Figure 5:
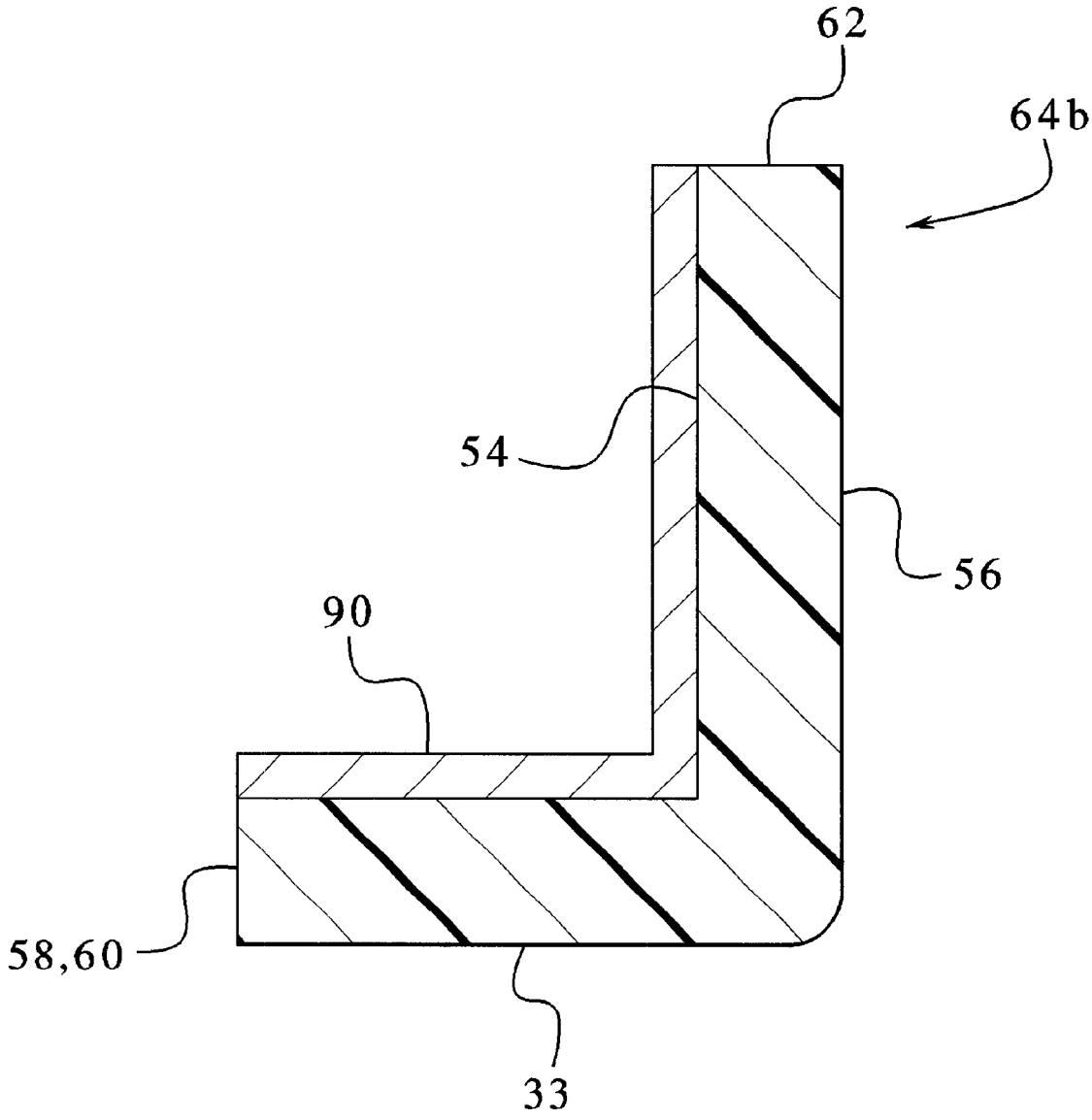
FIG. 5 is an enlarged cross-sectional view of an alternative embodiment of the protected coin tray of the present invention.

FIG. 5 illustrates the entire coin tray made of a suitable cushioning material with a metal layer 90 applied to the inner surface. As seen in FIG. 5, the bumper 64*b* has a bottom wall 33, side walls 54 and 56, ends 58 and 60 and edge 62 as described above. In this embodiment, a metal layer 90 is adapted to engage the bumper 64*b* using a friction fit or in a snap like fashion. Other suitable methods are contemplated such as adhesives, glues, bindings, screws and other fasteners.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a housing;

a game display mounted in the housing; and a coin tray formed from a cushioning material attached to the housing, said coin tray having a metal layer applied to an interior surface of the coin tray to provide a desired metal sound when a payout of a metal coin or token is dispensed from the housing into the tray.

* * * * *